US009046323B2

(12) United States Patent
Weber et al.

(10) Patent No.: US 9,046,323 B2
(45) Date of Patent: Jun. 2, 2015

(54) BALLISTIC PACKAGE FOR SOFT BODY ARMOR

(75) Inventors: Robert Weber, Mohave, AZ (US); David G. Miller, Pinon Hills, CA (US)

(73) Assignee: Safariland, LLC, Jacksonville, FL (US)

( * ) Notice: Subject to any disclaimer, the term of this patent is extended or adjusted under 35 U.S.C. 154(b) by 1695 days.

(21) Appl. No.: 12/391,187

(22) Filed: Feb. 23, 2009

(65) Prior Publication Data

US 2012/0174300 A1 Jul. 12, 2012

Related U.S. Application Data

(60) Provisional application No. 61/031,316, filed on Feb. 25, 2008.

(51) Int. Cl.
*F41H 1/02* (2006.01)
*F41H 5/04* (2006.01)

(52) U.S. Cl.
CPC ..... *F41H 1/02* (2013.01); *Y10T 428/19* (2015.01); *F41H 5/0471* (2013.01); *F41H 5/0478* (2013.01)

(58) Field of Classification Search
CPC ..... F41H 1/02
USPC ..... 2/2.5, 92; 428/469, 102, 911; 442/135, 442/134; 89/26.05
See application file for complete search history.

(56) References Cited

U.S. PATENT DOCUMENTS 1,758,296 A * 5/1930 Schaumann ..... 428/47
3,829,899 A * 8/1974 Davis ..... 2/2.5
4,224,096 A * 9/1980 Osborne ..... 156/380.9
4,241,457 A * 12/1980 Klein et al. ..... 2/2.5
4,316,286 A * 2/1982 Klein ..... 2/2.5
4,413,357 A * 11/1983 Sacks ..... 2/2.5
4,443,506 A * 4/1984 Schmolmann et al. ..... 428/102
4,457,985 A 7/1984 Harpell et al.
4,633,528 A * 1/1987 Brandt ..... 2/2.5
4,633,756 A * 1/1987 Rudoi ..... 89/36.02
4,650,710 A * 3/1987 Harpell et al. ..... 442/135
4,660,223 A * 4/1987 Fritch ..... 2/2.5
4,681,792 A * 7/1987 Harpell et al. ..... 428/102
4,697,285 A * 10/1987 Sylvester ..... 2/2.5
5,173,138 A 12/1992 Blauch et al.
5,185,195 A * 2/1993 Harpell et al. ..... 428/102
5,196,252 A * 3/1993 Harpell ..... 428/102
5,316,820 A 5/1994 Harpell et al.
5,362,527 A 11/1994 Harpell et al.
5,471,906 A * 12/1995 Bachner et al. ..... 2/2.5
5,479,659 A * 1/1996 Bachner, Jr. ..... 2/2.5
5,619,748 A * 4/1997 Nelson et al. ..... 2/2.5

(Continued)

OTHER PUBLICATIONS

International Search Report and Written Opinion for International Application No. PCT/US09/35087, mailed Oct. 15, 2009, 8 pages.

*Primary Examiner* — Richale Quinn
(74) *Attorney, Agent, or Firm* — Kane Kessler, P.C.; Paul E. Szabo

(57) ABSTRACT

A ballistic performance and trauma reduction system for soft body armor including a solid plastic sheet cut into multiple sections of geometric designs which overlap and are stitched to one or more layers of woven or non-woven ballistic fabric contained within a ballistic package of the soft body armor. Energy is transmitted through the ballistic sheets to the plastic sheet improving ballistic performance and reducing trauma to the wearer's body, resulting in safer, thinner and lighter armor.

7 Claims, 5 Drawing Sheets

(56) References Cited

U.S. PATENT DOCUMENTS

| | | | | | |
|---|---|---|---|---|---|
| 5,677,029 | A | | 10/1997 | Prevorsek et al. | |
| 5,724,670 | A | * | 3/1998 | Price | 2/2.5 |
| 5,918,309 | A | * | 7/1999 | Bachner, Jr. | 2/2.5 |
| 5,926,842 | A | * | 7/1999 | Price et al. | 2/2.5 |
| 5,996,115 | A | * | 12/1999 | Mazelsky | 2/2.5 |
| 6,026,509 | A | * | 2/2000 | Bachner, Jr. | 2/2.5 |
| 6,035,438 | A | * | 3/2000 | Neal et al. | 2/2.5 |
| 6,047,399 | A | * | 4/2000 | Bachner, Jr. | 2/2.5 |
| 6,138,275 | A | * | 10/2000 | Sacks | 2/2.5 |
| 6,154,880 | A | * | 12/2000 | Bachner, Jr. | 2/2.5 |
| 6,195,798 | B1 | * | 3/2001 | Bachner, Jr. | 2/2.5 |
| 6,240,557 | B1 | * | 6/2001 | Bachner, Jr. | 2/2.5 |
| 6,266,819 | B1 | * | 7/2001 | Bachner, Jr. | 2/2.5 |
| 6,370,690 | B1 | | 4/2002 | Neal | |
| 6,449,769 | B1 | * | 9/2002 | Bachner, Jr. | 2/2.5 |
| 6,684,404 | B2 | * | 2/2004 | Bachner et al. | 2/2.5 |
| 6,786,126 | B2 | * | 9/2004 | Sargent | 89/36.02 |
| 6,961,957 | B2 | * | 11/2005 | Carlson | 2/2.5 |
| 7,261,945 | B2 | * | 8/2007 | Biermann et al. | 428/469 |
| 7,294,218 | B2 | | 11/2007 | Haque et al. | |
| 8,336,112 | B2 | * | 12/2012 | Weber et al. | 2/2.5 |
| 2001/0053645 | A1 | | 12/2001 | Henderson | |
| 2002/0073473 | A1 | | 6/2002 | Bachner, Jr. et al. | |
| 2003/0066116 | A1 | | 4/2003 | Graves et al. | |
| 2007/0117483 | A1 | | 5/2007 | Bhatnagar et al. | |
| 2007/0238379 | A1 | | 10/2007 | Bhatnagar et al. | |
| 2007/0293109 | A1 | | 12/2007 | Bhatnagar et al. | |
| 2008/0044659 | A1 | | 2/2008 | Pilpel | |
| 2008/0064280 | A1 | | 3/2008 | Bhatnagar et al. | |

* cited by examiner

BALLISTIC PACKAGE FOR SOFT BODY ARMOR

CROSS-REFERENCE TO RELATED APPLICATION(S)

This application claims priority to and benefit of U.S. Provisional Patent Application No. 61/031,316 filed Feb. 25, 2008.

FIELD OF THE INVENTION

This invention relates to protective vests, and more particularly to a ballistic performance and trauma reduction system for soft body armor, which incorporates a ballistic subpack within the ballistic package having an overlapping multiple section plastic sheet stitched to one or more layers of ballistic fabric sheet.

BACKGROUND OF THE INVENTION

Ballistic vests have saved the lives of many law enforcement officers in recent years. As a result, law enforcement agencies have made it mandatory for their officers to wear ballistic vests while on duty.

Ballistic vests are available as a protective panel having overlying layers of a fabric made from woven high tensile strength fibers. Woven fabrics from an aramid fiber known as Kevlar, for example, have been used successfully in ballistic vests because of the high energy absorption properties of the fabric material. Comfort of the ballistic vest is extremely important, especially to law enforcement officers, because of the heat build up that occurs from wearing a heavy and inflexible vest for long hours while on duty. Resistance to projectile penetration is a principle factor in designing a ballistic vest; and added protective layers can offer greater protection against projectiles having the higher threat levels, but added protective layers also add undesirable weight and inflexibility of the vests.

In addition to woven Kevlar fabric layers, ballistic vests have been made from other high strength fibers and composites to reduce weight and improve flexibility of the vests. However, ballistic vests using the lighter, more flexible materials must offer the required minimum levels of protection against penetration by different types of projectiles. The more flexible the ballistic fabrics are, the more bunching and backface deformation occurs upon impact from a projectile. A vest must not be too flexible where it cannot protect the wearer.

Ballistic vests are regularly certified by subjecting them to ballistics testing to measure their ability to protect against different projectiles fired from different types of weapons at various angles. One ballistic test commonly used in the industry is the National Institute of Justice (NIJ) Standard 0101.03 Threat Level IIIA. Which, in general terms, is a high performance standard requiring that the ballistic vests prevent penetration of specified 0.44 Magnum and 9 mm rounds fired at a velocity of at least 1,400 feet per second. In addition to prevent such projectile penetration, "backface deformation" is also a required test factor in the certification test. Backface deformation measures the trauma level experienced by a projectile that does not penetrate the tests panel.

There is a need to provide a ballistic vest that is reasonably light in weight, is thin and is comfortable, and is also capable of meeting the high performance projectile specifications of certification testing. Providing such a vest at a reasonably low cost for the comparable high performance level also is a desirable objective. Consequently, a need exists for an improved soft body armor design, namely, to improve ballistic performance and comfort and to reduce weight while simultaneously reducing blunt trauma.

SUMMARY OF THE INVENTION

The present invention provides a ballistic vest of the soft body armor type comprising a plurality of over-laying first flexible layers arranged in a stack on a strike side of the vest, and a plurality of overlying second flexible layers arranged in a stack on a body side of the vest. Each first flexible layer comprises a thin, flexible, woven fabric layer made of high tensile strength polymeric fibers. The individual woven fabric layers form a soft, flexible woven fabric first panel for the vest. Each second flexible layer comprises a thin, flexible imperforate fiber-reinforced sheet comprising an array of fibers embedded in a thermoplastic resin matrix that forms each film sheet. Although this is one example of a ballistics package, any type and number of ballistics packages which meet any threat level are contemplated for use in the present invention. The vests of the present invention preferably is designed to be concealable, however it is to be understood that the inventive concepts are equally applicable to ballistic vests which are worn on the outside of the wearers' clothing or uniforms. The ballistics package of the present invention is equally applicable to other types of protective garments other than vests.

The ballistic vest of the present invention incorporates nylon hook fasteners to fasten the front panel to the back panel, and are attached to strapping or conventional elastic. Vests, or other garments of the present invention can also use buckles, zippers and other fastening systems.

More particularly, the ballistic vest of the present invention incorporates a subpack within the ballistics package which comprises a solid plastic sheet cut into multiple sections of geometric designs that overlap and are stitched to one or more layers of the woven or non-woven ballistic fabric contained within the package. Energy is transmitted through the ballistic layers to the attached sheet of plastic improving ballistic performance and reducing trauma to the wearer's body, resulting in safer, thinner, and lighter soft body armor. The invention also incorporates the use of woven or non-woven ballistic materials cut into geometric shapes and stitched together to form a sheet which is then attached to other layers of ballistic material in lieu of a plastic sheet. The ballistic energy is transmitted though the fibers which increases ballistic performance and reduces trauma.

The multi-section overlapping plastic sheet of the present invention permits the production of lower costs and lighter weight ballistic vests. The plastic sheet reduces the amount of depression or backface trauma caused by stopping a projectile. Consequently, injury caused by blunt force trauma is reduced, thereby improving safety of the vests. Because the plastic sheeting reduces the amount of material travel, the amount of ballistic materials can be reduced, thereby providing an effective ballistic system that is lighter in weight and thickness, which improves wear comfort and reduces the overall costs for manufacturing the vests.

Preferably the plastic sheet structure is sewn on top of one or more sheets within the multiple plys of ballistic fabric contained within the ballistic package. The plastic sheet is cut into geometric shapes and the individual shapes are overlapped and sewn with one or more lines of stitching on the overlapping sections as well as around the perimeter of the plastic sheet to the ballistic fabric. The ballistic fabric to which the plastic sheet is attached can consist of woven or non-woven Kevlar, Spectra Nylon or Zylon fibers or other known ballistic material. Because the plastic sheet is semi-rigid, it prevents the ballistics package from sagging and allows the vest to be worn in a loose condition, thereby reducing heat build-up and improving wear and comfort.

In a ballistic event, the projectile strikes the ballistics material and energy is transferred to the plastic sheet structure via the fibers in the ballistic fabrics. When the bullet contacts the surface, it expands, twists and becomes entangled in the fibers and tension is put on the fibers attached to the plastic sheet. The plastic sheet offers resistance to the amount of ballistic material travel and twist into the center area of impact. The plastic sheet thereby reduces the amount of depression of backface trauma caused by the slowing projectile. The plastic sheet by supporting the ballistic fabric reduces the chance of panel bunching or moving after a ballistic event.

BRIEF DESCRIPTION OF THE DRAWINGS

These and/or other features and advantages of the present invention will be more fully understood by reference to the drawings and following detailed description wherein.

DETAILED DESCRIPTION OF THE INVENTION

Figure 1:
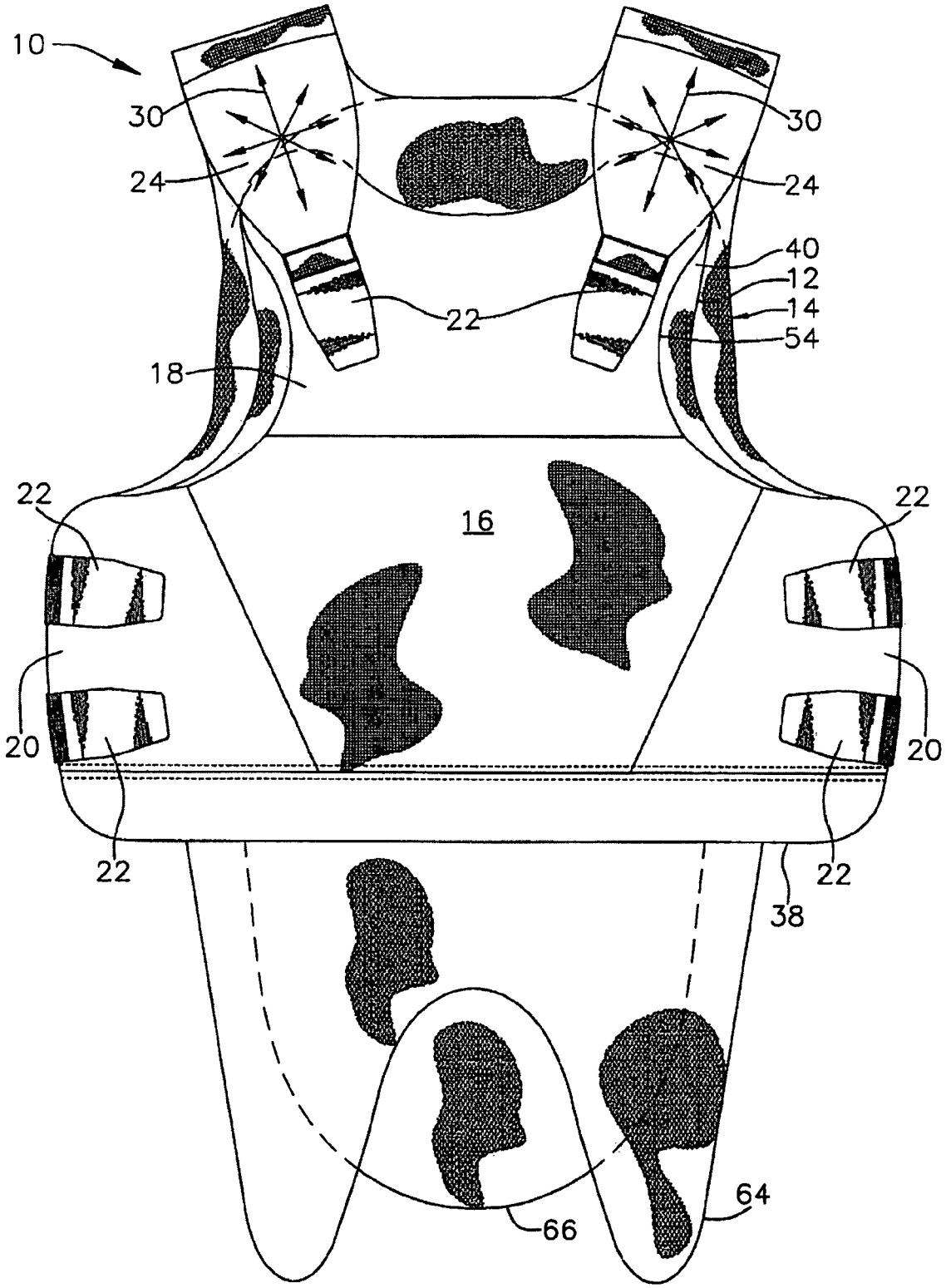
FIG. 1 is a front view of a ballistic vest of the present invention.
Figure 2:
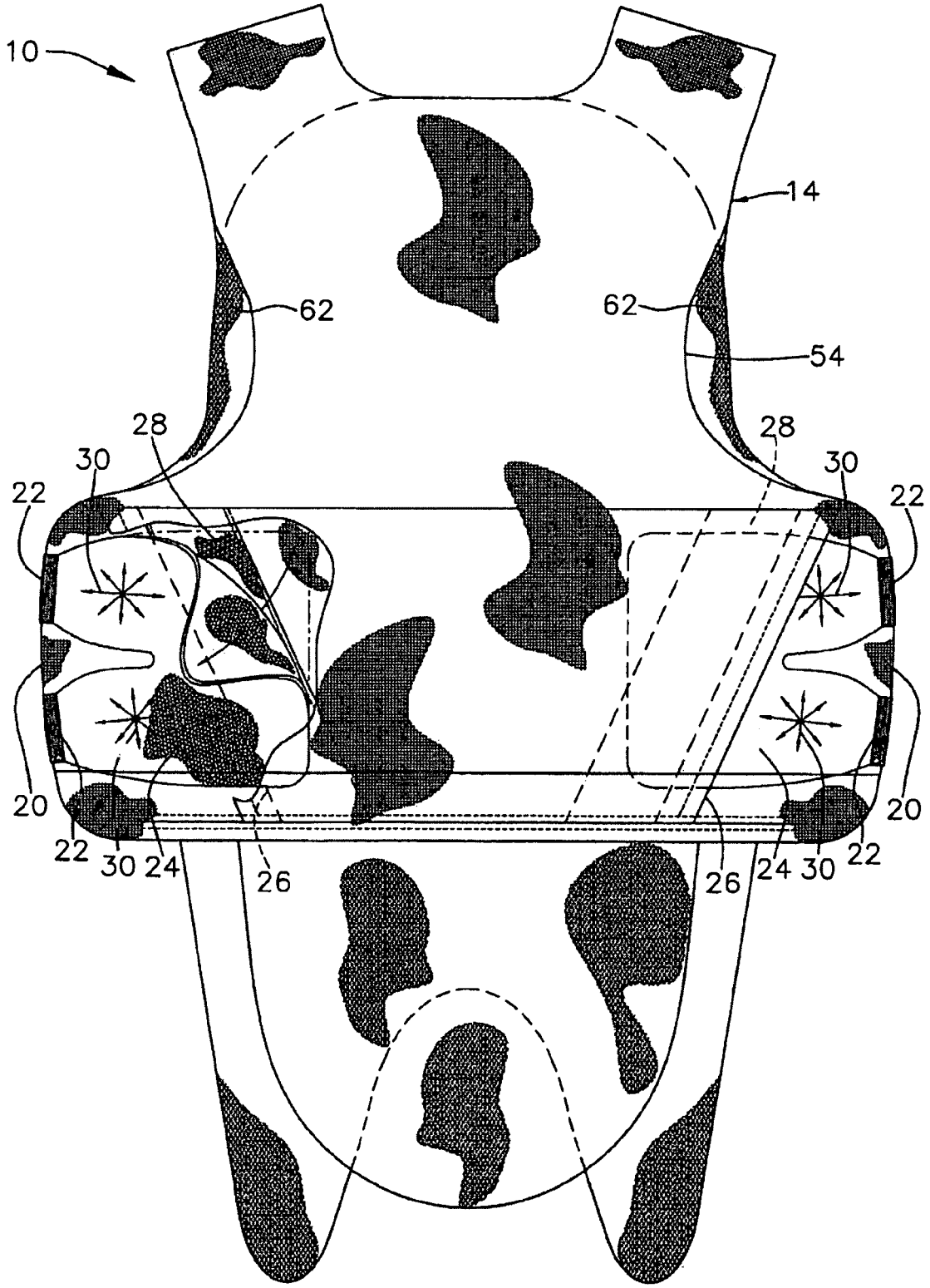
FIG. 2 is a back view of the ballistic vest of FIG. 1.

A ballistic vest 10 of the present invention is shown in FIGS. 1 and 2. The ballistic vest 10 is a concealable vest of the soft body armor type commonly worn by law enforcement officers. The ballistic vest includes a front panel 12 and a rear panel 14. The front panel 12 protects the chest and stomach of the wearer while the rear panel 14 protects the back of the wearer.

The front panel 12 may include a center panel 16 and hook compatible fabric located on the top 18 and sides 20 of the front panel 12. Top 18 and sides 20 provide a large area for hook fasteners 22 to secure the front panel and rear panel together around the wearer. Top 18 and sides 20 allow for placement of fasteners 22 at any location to provide an optimal fit for the particular wearer. Straps 24 located at the top and sides of the ballistic vest are attached to the fasteners 22 to secure the front and rear panels together. As seen best in FIG. 2, straps 24 for connecting the top of the front and rear panels can be typically sewn to the rear panel, or as with straps 24 located at the sides of the ballistic vests, can be inserted into a pocket 26 which includes a section of hook fasteners 28, sewn within the pocket, for connection of the straps 24. The pocket arrangement for the straps can be located at the top, sides or both locations of the vest. As indicated by the direction arrows 30, the straps 24 provide for multi-directional adjustment.

Figure 3:
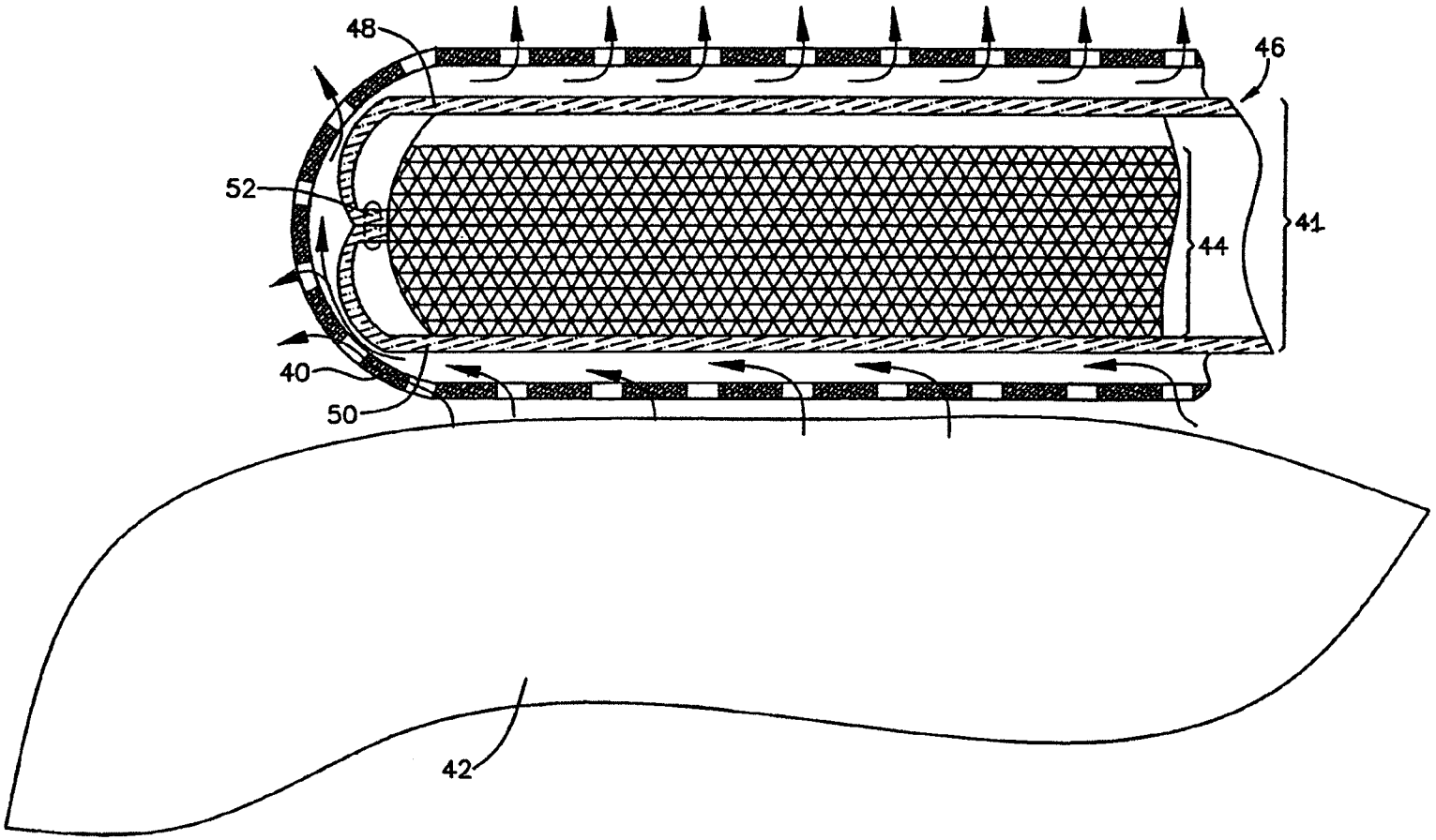
FIG. 3 is a partial cross-sectional view of the front panel of the ballistic vest of the present invention.

As shown as in FIG. 3, the front panel, as well as the rear panel, includes a lining material 40 which is adjacent the body 41 of the wearer and extends around the edge of the panel to the outside of the ballistic vest. The material can be perforated or of solid construction and is a moisture absorbing material which wicks moisture away from the body and around to the outside of the vest for evaporation. Contained within the lining material 40 is the ballistic panel or package 42 which comprises the individual layers of ballistic material 44 located within a covering layer 46. Layer 46 comprises a top layer 48 and a bottom layer 50 stitched together at internal seam 52. Gaps are shown between lining material 40 and top and bottom layers 48 and 50, and between layers 48 and 50 and ballistic material 44 only so that these components can be easily illustrated. It is to be understood that in the actual vest no gaps are present so that ballistic protection extends virtually from edge to edge in the front and rear panels. As shown in FIGS. 1 and 2. the lining material 40 extends around the outside surface of the vest and is sewn to the outside surface of the front and rear panels 12 and 14 to form a seam 54 which allows the ballistics package to extend all the way to the edge of the front and rear panels.

Figure 4:
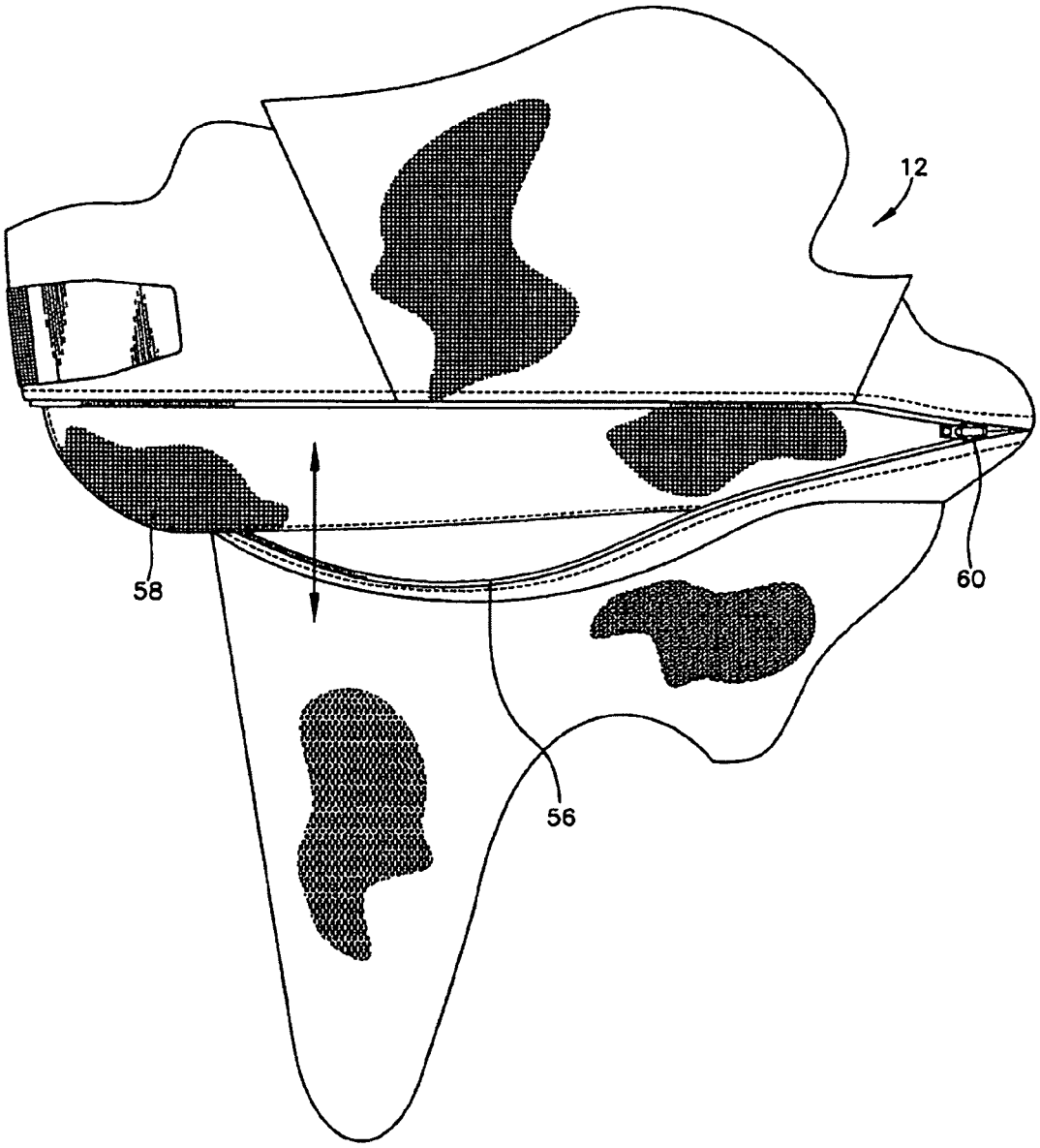
FIG. 4 is a detail of FIG. 1 illustrating access to the ballistics panel or package.

As shown in FIG. 4, the front panel 12 includes an opening 56 for access to the ballistics panel 58. The opening is positioned on the outside of the front panel to produce a smooth surface against the body. A zipper 60 or other suitable closing mechanism extends across the width of the opening. The zipper permits easy access to remove the ballistics panel or package.

As seen in FIG. 2, the ballistic vest includes visual inspection ports 62 positioned on the exterior of the garment. As shown in FIG. 1, retention tails 64 and 66 are sewn to the lower edge 38 of the front and rear panels respectively. Preferably the tails are constructed of stretchable fabrics or meshes which are tucked into a wearer's trousers to hold the vest down during movement.

Figure 5:
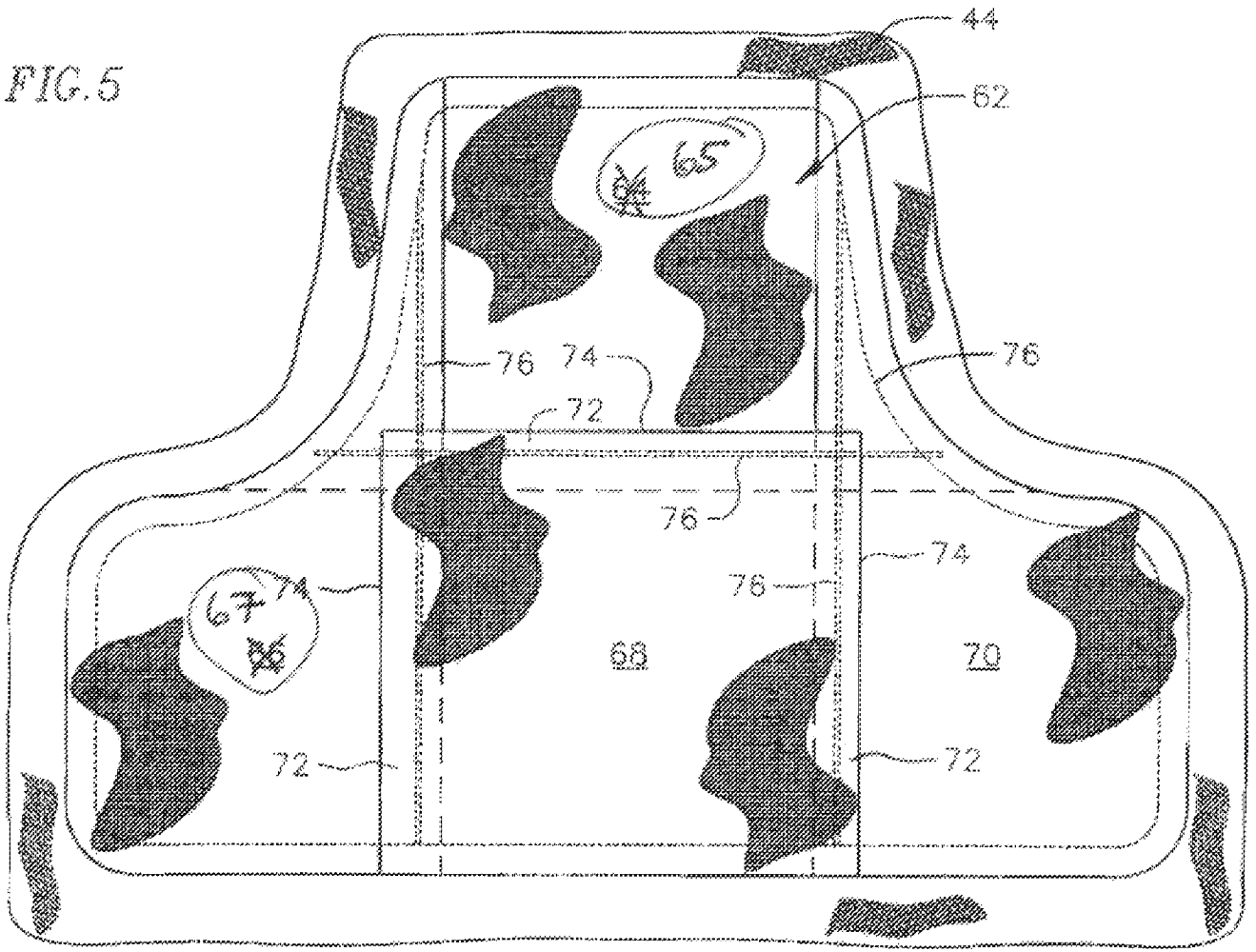
FIG. 5 is a front view of a multi-piece plastic sheet attached to ballistic material contained within the ballistic package of the vest of FIG. 1.

As shown in FIG. 5, the ballistic vest of the present invention includes a plastic sheet 62 attached to one or more layers of ballistic material 44. The plastic sheet comprises multiple sections 65, 67, 68 and 70 which can have various geometric designs and are attached to one or more of the ballistic sheets 44 such that the individual sections overlap 72 along an edge 74 of adjacent sections. Section 65 through 70 are sewn onto the ballistic material 44 by rows of stitching 76 which extends around the perimeter of the overall plastic sheet as well as through the overlapping portions 72 of the individual sections. Typically the outer perimeter of the plastic sheet is smaller than the ballistic material such that sheet is contained on the surface of the ballistic material.

The individual sections 65 through 70 are arranged such that they overlap one another between one to three inches and the stitching through these overlapping areas can be one or more rows of stitching. The multicomponent plastic sheet 62 can be attached to up to as many as 10 layers of ballistic material. The combination of plastic sheet 62 on one or more ballistic sheets 44 when sewn together can be referred to as a subpack which then is placed within the other ballistic sheets within the ballistic package. The number of other ballistic sheets as well as the number of subpacks contained within a single ballistic package can vary depending upon the threat level for which the ballistic vest is designed to protect against. Typically, the plastic sheet can have between two and six sections forming the sheet. Although the plastic sheet can be of a variety of plastics, preferably it is a low density polyethylene plastic or a self-reinforced polypropylene composite commercially available under the trademark "CURV" and manufactured by Propex Fabrics GMbH of Germany. Preferably there are two rows of stitching in the overlapping areas of the individual plastic sections. Preferably, the stitching for the plastic sheet is Kevlar stitching. Alternatively, sheet 62 can be made of a ballistic material, instead of plastic and the stitching utilized for this version could be nylon as well as Kevlar.

During a ballistic event, energy is transmitted through the fibers of the individual ballistic sheets to the plastic sheet improving ballistic performance and reducing trauma to the wearer's body, resulting in safer, thinner and lighter armor. Although the present invention has been shown and illustrated with respect to an embodiment thereof, the invention is not to be so limited since changes and modifications can be made therein which are within the scope of the invention as hereinafter claimed.

What is claimed is:

1. A ballistic panel for use in ballistic apparel comprising:

a plurality of layers of ballistic material; and a plastic sheet comprising multiple sections partially overlapping one another, wherein the plastic sheet is attached to at least one layer of ballistic material by stitching along overlapping portions and a perimeter of the plastic sheet;

wherein the plastic sheet extends laterally across substantially the entire width of the panel;

the sheet comprising at least three plastic sections arranged laterally adjacent to each other across the width of the panel with each one of the sections extending laterally for about one third of the width of the panel, each two adjacent sections overlapping each other only along their respective edge portions, a substantial majority of the surface area of each section not overlapping any part of any other section.

2. The panel of claim 1 wherein the plastic sheet has between three and six sections.

3. The panel of claim 1 wherein the plastic sheet has two rows of stitching along the overlapping portions.

4. The panel of claim 1 wherein the plastic sheet is a self-reinforced polypropylene composite material.

5. A panel as set forth in claim 1 wherein the width of the area of overlap of any two adjacent sections, as measured in a direction extending across the width of the panel, is in the range of up to about 10% of the total width of the sheet.

6. A panel as set forth in claim 5 wherein the width of the area of overlap of any two adjacent sections, as measured in a direction extending across the width of the panel, is in the range of up to about 20% of the section width of the any two adjacent sections.

7. A panel as set forth in claim 6 wherein the width of the area of overlap of any two adjacent sections, as measured in a direction extending across the width of the panel, is in the range of about one to three inches.

* * * * *